United States Patent [19]

Sonns

[11] 4,398,433

[45] Aug. 16, 1983

[54] SHIFT LEVER ASSEMBLY

[75] Inventor: Eugen Sonns, Heddesheim, Fed. Rep. of Germany

[73] Assignee: Deere & Company, Moline, Ill.

[21] Appl. No.: 282,637

[22] Filed: Jul. 13, 1981

Related U.S. Application Data

[63] Continuation of Ser. No. 133,179, Mar. 24, 1980, abandoned.

[30] Foreign Application Priority Data

Jul. 5, 1979 [GB] United Kingdom ..... 7923520

[51] Int. Cl.[3] ..... G05G 5/02; G05G 7/00

[52] U.S. Cl. ..... 74/475; 74/526; 74/565

[58] Field of Search ..... 74/475, 526, 565

[56] References Cited

U.S. PATENT DOCUMENTS

| | | | |
|---|---|---|---|
| 1,497,847 | 6/1924 | Gwynn et al. | 74/565 |
| 1,791,469 | 2/1931 | Maranda | 74/526 X |

FOREIGN PATENT DOCUMENTS

| | | | |
|---|---|---|---|
| 260409 | 11/1926 | United Kingdom | 74/565 |
| 1047011 | 11/1966 | United Kingdom . | |
| 1371476 | 10/1974 | United Kingdom . | |
| 1406795 | 9/1975 | United Kingdom . | |

*Primary Examiner*—Carl D. Friedman

[57] ABSTRACT

This invention relates to a shift lever assembly for changing the speed of a power take-off shaft of a tractor. The assembly comprises a movable rod positioned between two different speed positions having a neutral position therebetween. The rod has abutment means secured to it which cooperates with knotched plates so that the rod can be moved in a linear direction between the speed positions only when it is rotated while in the neutral position.

12 Claims, 15 Drawing Figures

SHIFT LEVER ASSEMBLY

This is a continuation of application Ser. No. 133,179, filed Mar. 24, 1980 now abandoned.

BACKGROUND OF THE INVENTION

1. Field of the Invention

This invention relates to a shift lever assembly for changing the speed of a power take-off shaft of a tractor.

2. Description of the Prior Art

It is known in tractor design to use a power take-off shaft, hereinafter referred to as PTO, which is capable of being driven selectively at either of two standard speeds, namely 540 rpm and 1000 rpm. The drive for the PTO shaft is shiftable for the different speeds by a lever arrangement which the driver moves manually from his seat in the tractor cab.

In one such arrangement, two manual levers are provided which, when moved, for example, from the 540 rpm to the 1000 rpm position, must be handled three times, i.e. one lever is moved, then the other, and finally the first lever is again shifted. The system is complicated because it is necessary to design into any shifting arrangement a safety feature which prevents inadvertent movement from one speed to the other. This feature is needed because machinery which is to be driven by the PTO is adapted to operate at only one of the two standard speeds.

SUMMARY OF THE INVENTION

Briefly, the present invention relates to a shift lever assembly for changing the speed of a power take-off shaft of a tractor. This assembly comprises a movable rod positioned between two different speed positions with a neutral position therebetween. There is an abutment means attached to the rod which, when the rod is in the neutral position, prevents the rod from moving in a linear direction between the speed positions. However, the rod can clear the abutment means at the neutral position by being rotated, preferably 0–180 degrees.

The general object of this invention is to provide a shift lever assembly which is simple to operate. A more specific object is to provide a shift lever assembly which requires only one manual shift lever to be employed.

Another object of this invention is to provide a shift lever assembly wherein the assembly cannot be inadvertently moved from one speed to the other.

Other objects and advantages of the present invention will become more apparent to those skilled in the art in view of the following description and the drawings.

DETAILED DESCRIPTION OF THE INVENTION

Figure 1:
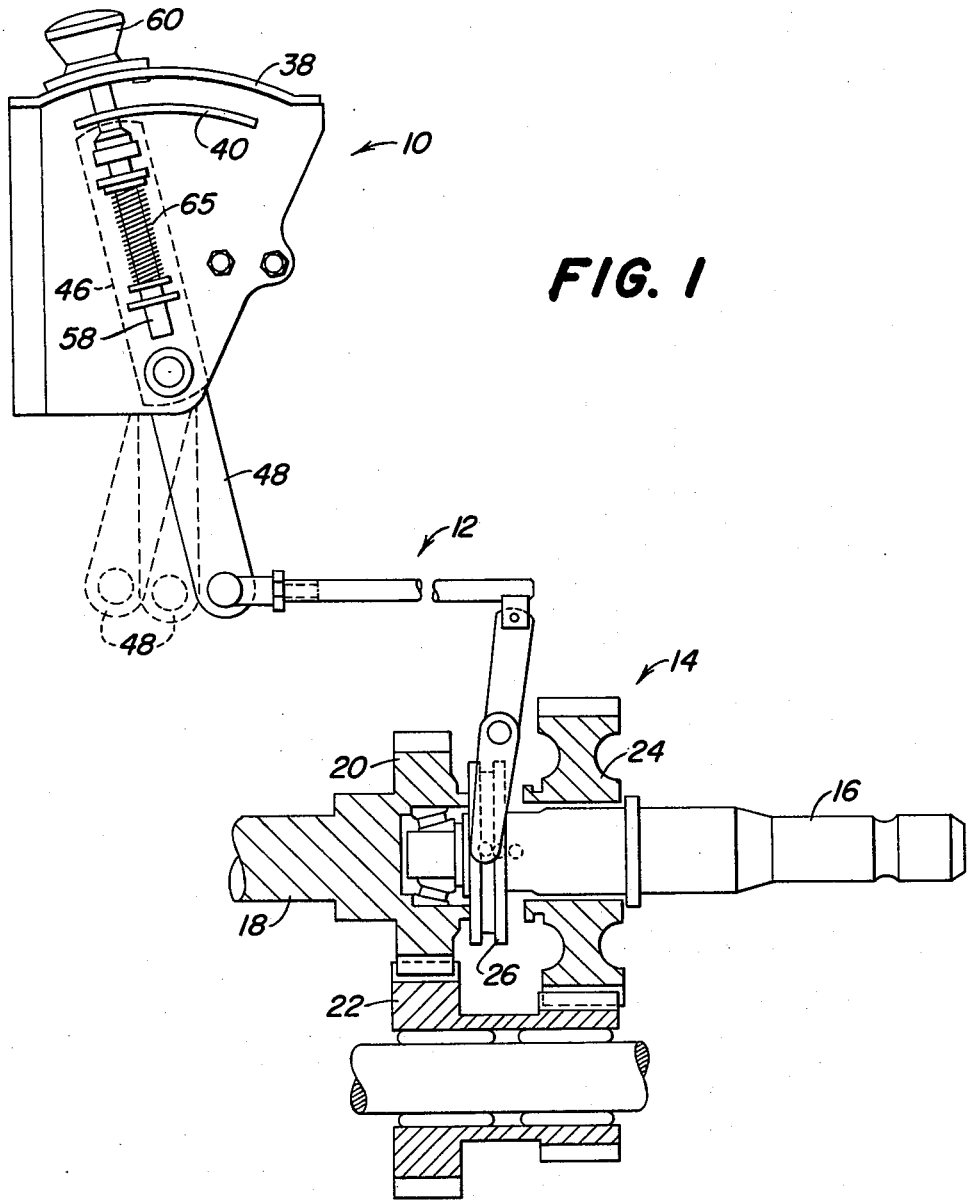
FIG. 1 is a schematic view of a shift lever assembly for changing the speed of a PTO shaft, including an output shaft to which the PTO shaft is connected, and a linkage (in part) between the assembly and output shaft.
Figure 2:
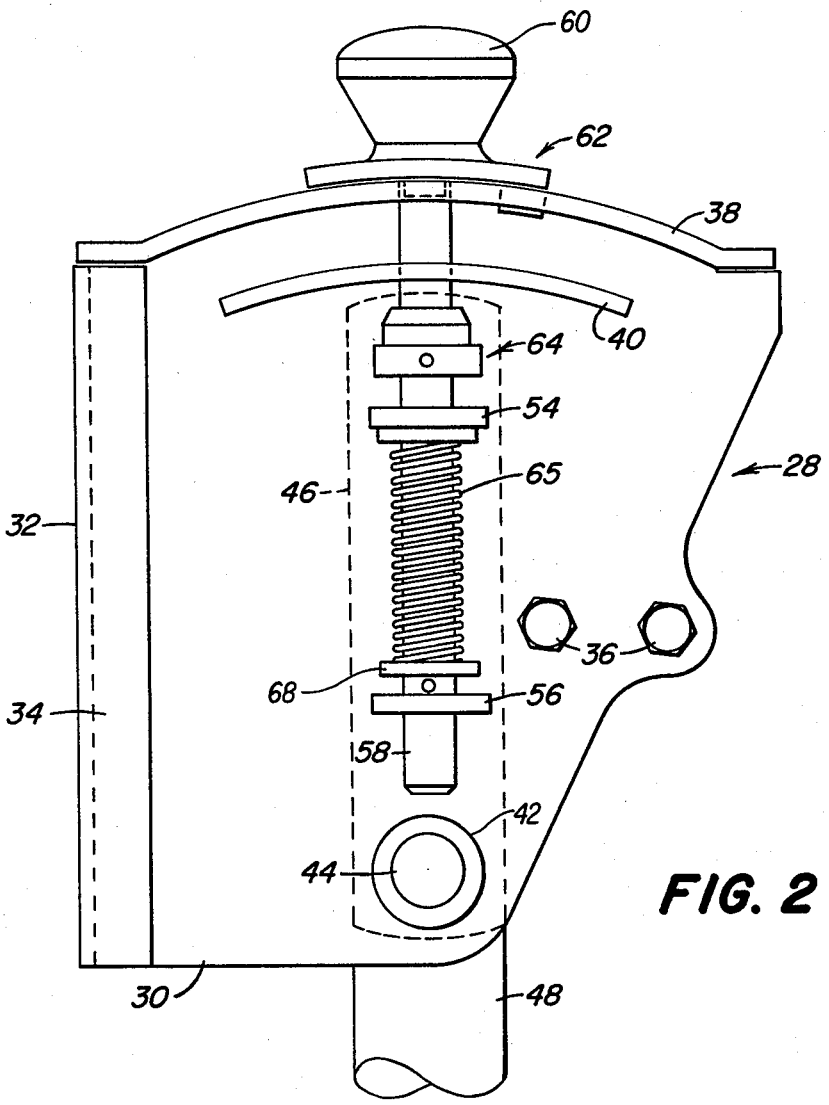
FIG. 2 is a side view of the shift lever assembly of FIG. 1 from within a housing of the assembly.

In FIG. 1, a shift lever assembly 10 is connected by way of a linkage 12 to transmission gearing 14 associated with a power take-off shaft 16. The PTO shaft 16 is driven at selected speeds, for example, 1000 rpm and 540 rpm. The linkage 12 and the transmission gearing 14 are known and therefore will only be described briefly.

An input stub shaft 18 driven by the tractor engine (not shown) and in line with the PTO shaft 16 is integral with a spur gear 20 which carries the drive to an idler gear 22. The idler gear 22 is capable of meshing with a gear 24 journaled on the PTO shaft 16. Thus, the gears 20 and 24 are permanently driven.

The PTO shaft 16 carries a gear collar 26 which is splined onto the PTO shaft 16 so that limited axial movement is permitted. The gear collar 26 is located between the gears 20 and 24 and is pivotally connected to the linkage 12 for its axial movement between three positions, namely a first position in which the gear collar 26 is in engagement with the gear 20, a second position in which the gear collar 26 is out of engagement, and a third position in which the gear collar 26 engages the gear 24. These positions correspond to the 1000 rpm position, the neutral position, and the 540 rpm position respectively, on the PTO shaft 16.

Turning now to the shift lever assembly 10 which can best be seen in FIGS. 2–8, the assembly 10 has a housing 28 which has an outer wall 30 and an end wall 32. The end wall 32 contains a short flange 34 aligned parallel to the outer wall 30. The housing 28 is attached to a wall of the tractor cab or to an appropriate part of a rear wheel fender by bolts 36 with the outer wall 30 closest to the driver. An upper slot plate 38, arcuate in shape, forms the top of the housing 28. The upper slot plate 38 is convex when viewed from above. A lower slot plate 40 is welded to the outer wall 30 and is spaced a short distance below the upper slot plate 38. The lower slot plate 40 is curved so that the arc it follows is co-axial with that of the upper slot plate 38. However, the lower slot plate 40 is somewhat shorter.

Figure 3:
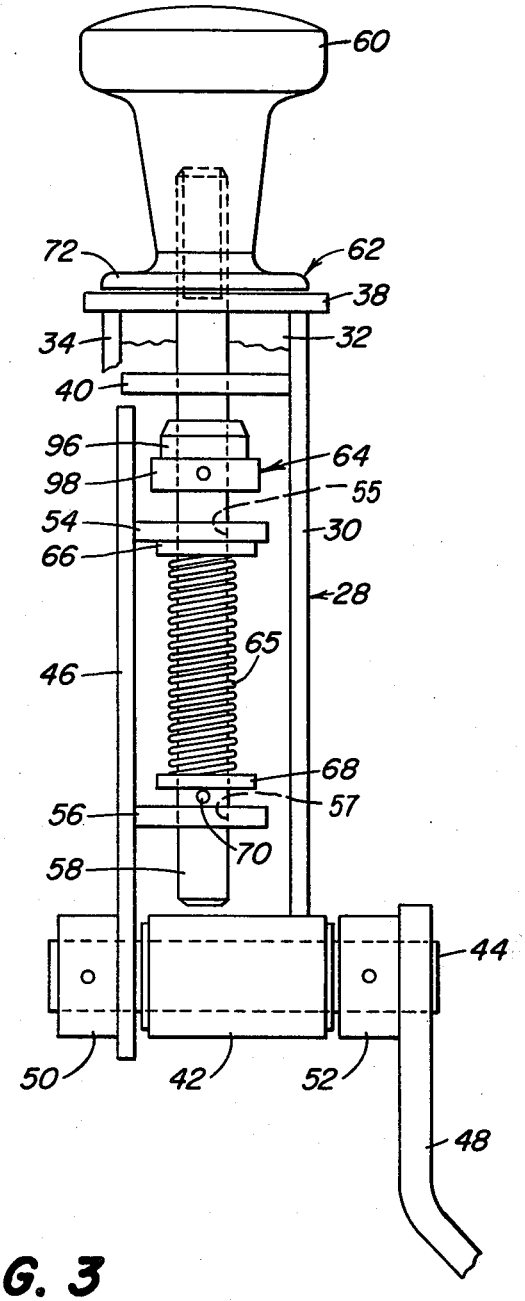
FIG. 3 is an end view of the assembly.
Figure 4:
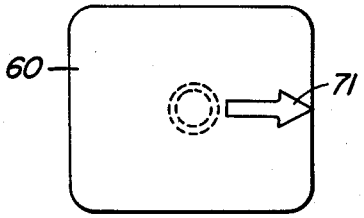
FIG. 4 is a plan view of a knob for grasping by the operator, of the shift lever assembly.

Referring now to FIG. 3, a box-shaped carrier 42 is welded to the bottom portion of the outer wall 30 under the lower slot plate 40. A horizontal shaft 44 is journaled in the carrier 42 and is rigidly connected at its inner end to an upper lever 46 and at its outer end to a lower lever 48. The levers 46 and 48 are integral with bosses 50 and 52, respectively, through which the connection to the horizontal shaft 44 is made. In turn, the upper lever 46 has welded to its outer face a pair of spaced apart vertically aligned lugs 54 and 56.

A rod 58 extends downwardly through the upper slot plate 38, the lower slot plate 40, and through aligned apertures 55 and 57, formed in the lugs 54 and 56, respectively. The rod 58 terminates a short distance above the carrier 42. The rod 58 is vertically movable in the lugs 54 and 56 and in the upper and lower plates 38 and 40. The rod 58 can move lengthwise of the upper and lower plates 38 and 40 and can also be rotated. A knob 60, which can be grasped by the driver, is provided at the top of rod 58 for the purpose of moving the rod 58. The knob 60 is integral with a knob base 62 which normally engages the upper slot plate 38 and which will be described in more detail below.

The rod 58 has an abutment 64 secured to it which cooperates with the lower slot plate 40. The rod 58 is loaded downwardly by a spring 65 which is in contact at its upper end with a washer 66 bearing against the underside of the lug 54 and is in contact at its lower end with a corresponding washer 68 held against downward movement on the rod 58 by a split pin 70. The split pin 70 normally lies in abutment against the upper face of the lower lug 56.

Now the upper and the lower slot plates 38 and 40, respectively, and the parts cooperating with them will be described. FIGS. 4–8 are particularly relevant. It can be seen from FIG. 4 that the top of the knob 60 bears the marking of an arrow 71 which indicates the lengthwise direction in which the knob 60 can be moved in relation to the upper slot plate 38.

Figure 5:
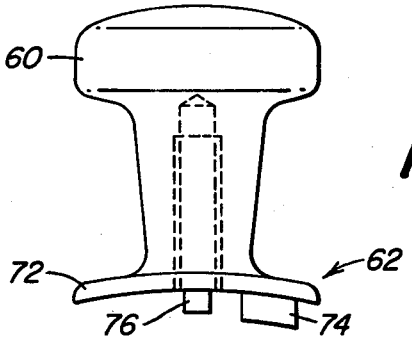
FIG. 5 is a side view of the knob and a knob base.
Figure 6:
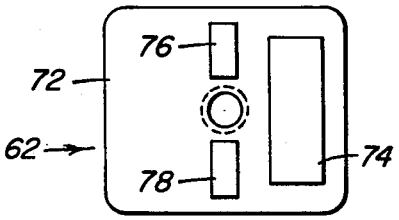
FIG. 6 is a view of the knob base of FIG. 5 from its underside.

The knob base 62, best shown in FIGS. 5 and 6, includes a knob plate 72, a rectangular transverse deep stop 74, and a pair of rectangular transverse shallow stops 76 and 78. The knob plate 72 is arcuate in shape in its lengthwise direction to conform with the curvature of the upper slot plate 38. The deep stop 74 is integral with the underside of the knob plate 72 as are the shallow stops 76 and 78. The shallow stops 76 and 78 are aligned parallel to each other and are positioned so that a shallow stop is positioned on either side of the rod 58 and also rigid with the underside of the upper slot plate 38. The outward ends of the shallow stops 76 and 78 (with respect to the knob plate 72) are closer to the periphery of the knob plate 72 than the corresponding ends of the deep stop 74.

Figure 7:
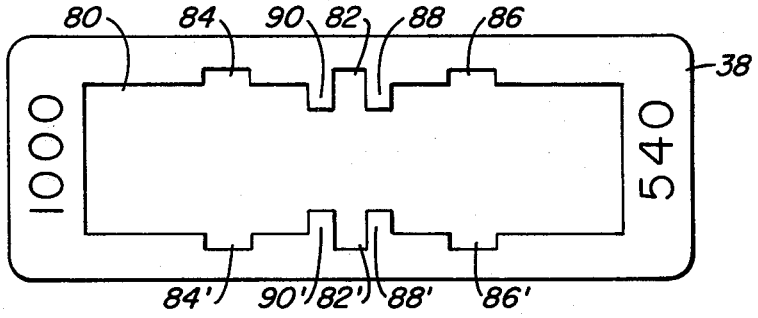
FIG. 7 is a top view of the upper slot plate of the assembly.

The upper slot plate 38, see FIG. 7, contains a longitudinal slot 80 in which a pair of central notches 82 and 82' are formed, a pair of left-hand notches 84 and 84' (as viewed in FIG. 7), and a pair of right-hand notches 86 and 86'. These notches 82, 82', 84, 84', and 86, 86' are formed so as to receive the shallow stops 76 and 78. The notches 82, 82', 84, 84', and 86, 86', therefore, provide the maximum width of the slot 80 while the main portion of the slot 80 receives the deep stop 74. Two pairs of projections 88, 88', and 90, 90' extend into the main portion of the slot 80 on either side of the pair of notches 82 and 82' and form abutments both for the deep stop 74 and for the shallow stops 76 and 78.

At either end of the upper slot plate 38, there is a marking of the speed selected, namely 540 rpm or 1000 rpm. Other rpm values may be substituted for the 540 rpm and 1000 rpm values stated herein, depending upon the type of transmission which is present in the vehicle.

Figure 8:
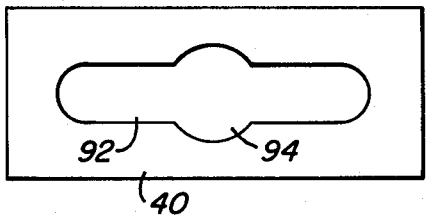
FIG. 8 is a top view of the lower slot plate of the assembly.

The lower slot plate 40, see FIG. 8, cooperates with the abutment 64 on the rod 58 and comprises a simple slot 92 with rounded ends and a circular recess 94 disposed centrally therein. The width of the main portion of the slot 92 is sufficient to receive the rod 58 but not the abutment 64, see FIG. 9.

The abutment 64 on the rod 58 is depicted as circular in horizontal cross section, see FIG. 3, having an upper portion 96 and a lower portion 98 which is of greater diameter. The dimensions are such that the upper portion 96 but not the lower portion 98 can be received in the rounded recess 94 upon movement of the rod 58 upwardly when the lower portion 98 comes into abutment with the underside of the lower stop plate 40, see FIG. 15.

Operation

The operation of the shift lever assembly 10 will now be described, referring particularly to FIGS. 9–15.

Figure 9:
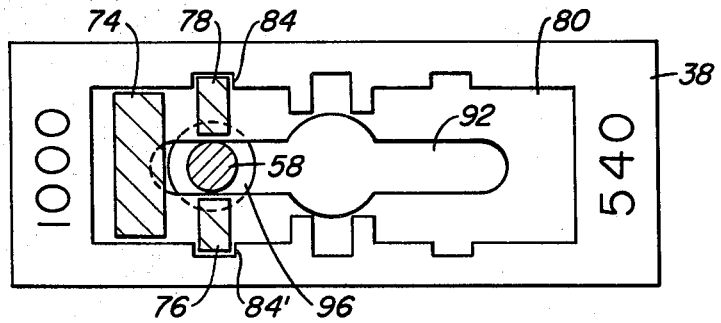
FIGS. 9–12 illustrate, in schematic plan view, stepwise movement of the assembly from the 1000 rpm position to the 540 rpm position, the knob being omitted.
Figure 13:
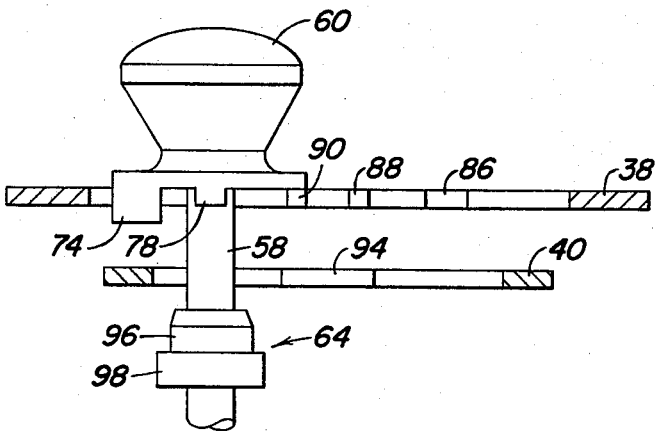
FIGS. 13–15 illustrate, in a schematic side view, stepwise movement of the assembly from the 1000 rpm position to the 540 rpm position.

Arbitrarily starting with the knob 60 in the 1000 rpm position at the left-hand end of the upper slot plate 38, see FIGS. 9 and 13, it will be seen that the deep stop 74 lies in the main portion of the slot 80 at its left-hand end and the two shallow stops 76 and 78 are received in the notches 84 and 84'. This 1000 rpm position is maintained by the loading provided by the spring 65 while the knob plate 72 is in abutment with the upper slot plate 38. At the same time, the upper portion 96 of the abutment 64 is clear of the lower slot plate 40, as shown in FIG. 13. The lower lever 48, see FIG. 1, is then in a full line disposition, i.e., it is furthest to the right as viewed in FIG. 1. In this position, the gear collar 26 is in engagement with the gear 20 to provide an output of 1000 rpm. The arrow 71 on the top face of the knob 60 will point toward the 1000 rpm mark on the upper slot plate 38.

In order to change to a neutral position, the following sequence is affected. In the 1000 rpm position, the knob 60 is prevented from moving along the slot 80 due to the engagement of the shallow stops 76 and 78 in the notches 84 and 84'. Therefore, to move the knob 60 to the right, the knob 60 is pulled upwardly against the spring-loading of the spring 65 to free the shallow stops 76 and 78 from the notches 84 and 84'.

Figure 14:
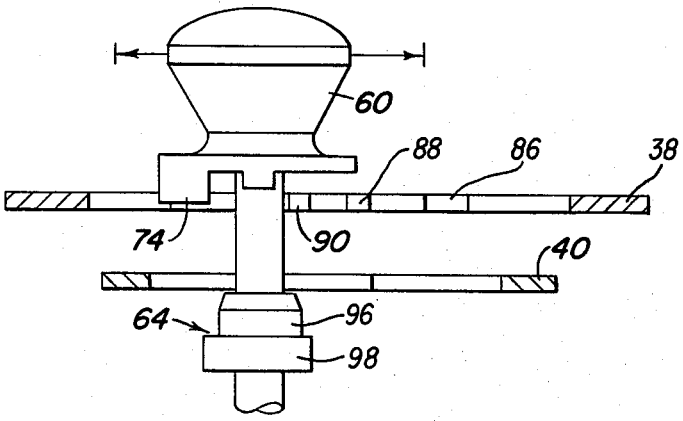

During the move to the right as can best be seen from FIG. 14, the abutment 64 contacts the underside of the lower slot plate 40. The knob 60 can continue to be moved to the right until the deep stop 74 abuts the pair of projections 90 and 90', see FIG. 10. It is important that the knob 60 be prevented from being moved directly along the slot 80 to the 540 rpm position since such movement might otherwise be made inadvertently and the shift lever assembly 10 would not then meet the safety requirement referred to above.

Figure 10:
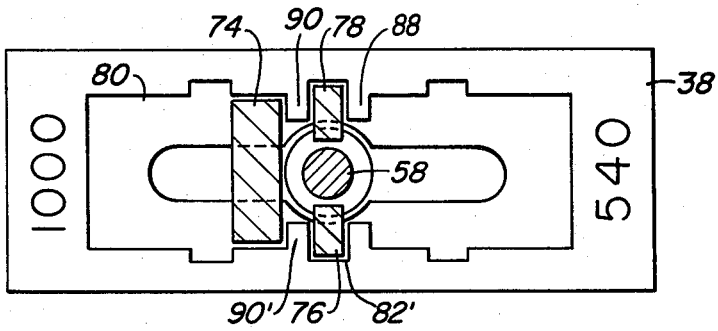

If the knob 60 is released at this neutral position, as shown in FIG. 10, the deep stop 74 will be received in the slot 80 of the upper plate 38 adjacent to the pair of projections 90 and 90'. Simultaneously, the shallow stops 76 and 78 will be received in the notches 82 and 82'. Even if the knob 60 is pulled upwardly in this position to its fullest extent, see FIG. 15, and although the deep stop 74 and the shallow stops 76 and 78 will clear the upper slot plate 38, the upper portion 96 of the abutment 64 will enter the circular recess 94 of the lower slot plate 40 and will prevent any movement to the right (and incidentally, also to the left).

Here, in the neutral position, the lower lever 48, see FIG. 1, is in a midway position indicated by the broken lines at which the gear collar 26 is disengaged.

Figure 11:
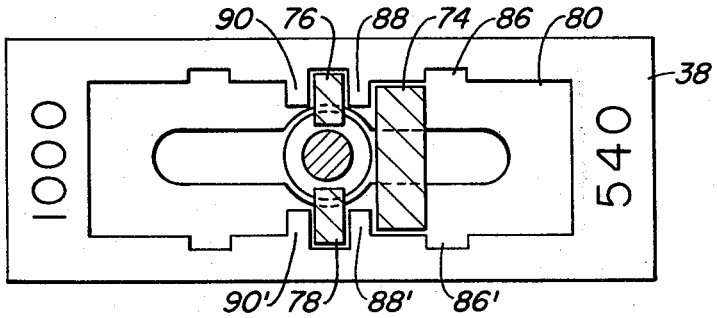
Figure 12:
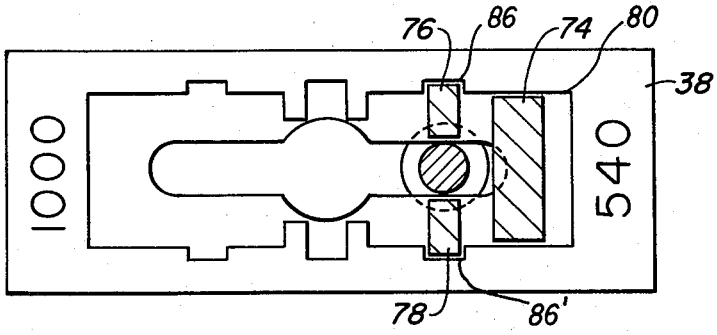
Figure 15:
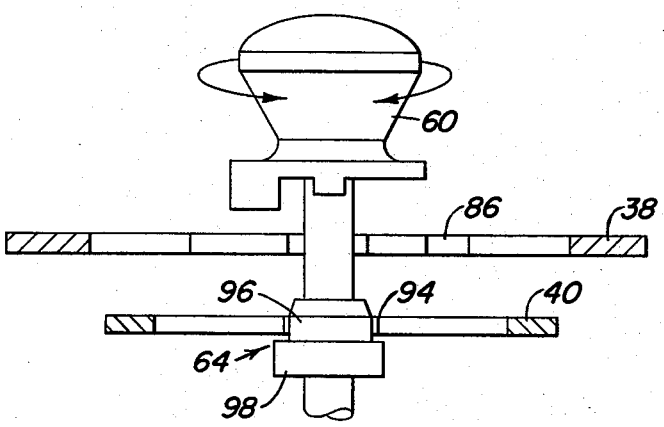

In order to enable the knob 60 to be moved further toward the 540 rpm position, it is necessary to lift the knob 60 to its fullest extent as mentioned above and then to rotate it, preferably between 0 and 180 degrees, as indicated in FIG. 15. If the knob 60 is released, the stops 74, 76 and 78 will re-engage the slot 80, as shown in FIG. 11, under the influence of the spring 65. This does not, of course, alter the position of the lower lever 48 which is still at the midway broken line neutral position as shown in FIG. 1.

The knob 60 is now free to be moved to the right by simply lifting it so that the shallow stops 76 and 78 clear the pair of projections 88 and 88'. If the knob 60 is released at the far right of its travel, the shallow stops 76 and 78 will be received in the pair of notches 86 and 86' and the deep stop 74 will be received in the slot 80 adjacent to the 540 rpm marking on the upper plate 38. The lower lever 48 is then at its far left broken line position in FIG. 1 with the gear collar 26 in engagement with the gear 24.

To change the knob 60 back to the 1000 rpm position, a similar procedure is followed in the opposite direction.

Thus, movement between the two speed positions, i.e. (1000 rpm and 540 rpm) is not possible without rotating the knob 60 at the neutral position. Furthermore, the whole movement can be made with one hand simply by having the operator grasp the knob 60 and either moving it laterally or rotating it.

In a modified embodiment, the upper slot plate 38 and the lower slot plate 40 may be formed by stamping from a single plate.

The notches 82, 82', 84, 84', and 86, 86' need not extend entirely through the thickness of the upper slot plate 38. In addition, the notches 82, 82', 84, 84', and 86, 86' can have bevelled sides so that movement of the shallow stops 76 and 78 in and out of the notches is made easier.

In a preferred embodiment, the shift lever assembly 10 includes a spring-loaded rotatable rod 58, linearly movable between two different speed positions with the neutral position inbetween. A linkage means 48 connects the rod 58 to the power take-off shaft 16. Attached to the lower end of the rod 58 is a circular step-like disc abutment means 64 having an upper portion 96 and a larger lower portion 98. On top of the rod 58 is attached a knob 60 and a knob plate 72. The knob plate 72 is attached to the bottom of the knob 60 and contains a deep stop 74 and a pair of shallow stops 76 and 78. All three stops 74, 76 and 78 project downward and are engageable with the upper slot plate 38. This upper slot plate 38 has formed therein three pairs of oppositely aligned notches 82, 82', 84, 84' and 86, 86' located along the length of the slot 80. Each pair of notches corresponds to one of the speed positions or with the neutral position. In these notches, the deep stop 74 and the shallow stops 76 and 78 are engageable with the slot 80. The configuration of the stops 74, 76 and 78 and the notches 82, 82', 84, 84' and 86, 86' enables the rod 58 to be moved in a linear direction between the two speed positions and the neutral position. In cooperation with the above, there is a lower slot plate 40 having a circular recess 94 located at the neutral position. This circular recess 94 receives the upper portion 96 of the abutment means 64 and blocks linear movement of the rod 58 at the neutral position until the rod 58 is rotated and allowed to move downward. Preferably, the rod 58 is rotated anywhere from 0 to 180 degrees.

While the invention has been described in conjunction with a specific embodiment, it is to be understood that many alternatives, modifications, and variations will be apparent to those skilled in the art in light of the aforegoing description. Accordingly, it is intended to embrace all such alternatives, modifications, and variations which fall within the spirit and scope of the appended claims.

I claim:

1. A shift lever assembly for changing the speed of a rotatable shaft, comprising:

(a) a first plate containing a slot having at least three pairs of notches formed thereon, two pairs of said notches corresponding to two speed positions and said third pair of notches corresponding to a neutral position which is located between said two speed positions;

(b) a second plate containing a slot with a recess formed thereon corresponding to said neutral position;

(c) a movable rod attached to said rotatable shaft and passing through said slots formed in said first and second plates;

(d) a knob attached to said rod having stop means engageable with said notches of said first plate to position said rod in said speed positions and said neutral position; and (e) abutment means for preventing said rod from moving directly from one speed position to the next until said rod is rotated while in the neutral position.

2. The shift lever assembly of claim 1 wherein said rod is spring-loaded downward.

3. The shift lever assembly of claim 2 wherein said rod can be rotated from 0 to 180 degrees.

4. The shift lever assembly of claim 1 wherein said stop means includes a deep stop and a pair of shallow stops.

5. The shift lever assembly of claim 4 wherein shallow stops are aligned parallel to each other.

6. The shift lever assembly of claim 5 wherein said knob contains a direction of movement indicator.

7. A shift lever assembly for changing the speed of a power take-off shaft of a tractor, comprising:

(a) a first plate containing a linear slot having a pair of notches corresponding to each speed position and to a neutral position, said neutral position located between said speed positions;

(b) a second plate aligned adjacent to said first plate containing a linear slot with a circular recess located at said neutral position;

(c) a movable spring-loaded rod attached to said power take-off shaft and passing through said slots formed in said first and second plates;

(d) a knob attached to said rod having stop means engageable in said notches of said first plate to position said rod in said speed positions and in said neutral position; and (e) an abutment member fixed to said rod and engageable in said circular recess of said second plate for preventing said rod from moving directly from one speed position to a second speed position until said rod is rotated while in the neutral position.

8. The shift lever assembly of claim 7 wherein said rod is spring-loaded downward.

9. The shift lever assembly of claim 7 wherein said rod can be rotated from 0 to 180 degrees.

10. The shift lever assembly of claim 7 wherein said abutment is a circular step-like disc having an upper portion and a larger lower portion.

11. The shift lever assembly of claim 10 wherein only said upper portion of said abutment is engageable in said circular recess of said second plate.

12. A shift lever assembly for changing the speed of a power take-off shaft of a tractor, comprising:

(a) a first plate containing a linear slot having at least three pairs of notches formed therein and having two pairs of projections located adjacent to the middle pair of notches, said middle pair of notches corresponding to a neutral position and said other two pairs of notches corresponding to two speed positions;

(b) a second plate vertically aligned to said first plate containing a linear slot with a circular recess located at said neutral position;

(c) a movable rod spring-loaded downward which passes through said slots formed in said first and second plates;

(d) linkage means for connecting a first end of said rod to said power take-off shaft;

(e) a knob attached to a second end of said rod having stop means engageable in said notches of said first plate to position said rod in said speed positions and in said neutral position; and (f) an abutment member fixed to said rod below said second plate an engageable in said circular recess of said second plate when said rod is moved to said neutral position, said abutment member preventing said rod from being moved directlyy from one speed position to the second speed position until said rod is rotated while in the neutral position.

* * * * *